US008456260B2

(12) United States Patent
Steeneken et al.

(10) Patent No.: US 8,456,260 B2
(45) Date of Patent: Jun. 4, 2013

(54) MEMS SWITCH

(75) Inventors: Peter Gerard Steeneken, Valkenswaard (NL); Hilco Suy, Hulst (NL)

(73) Assignee: NXP B.V., Eindhoven (NL)

( * ) Notice: Subject to any disclaimer, the term of this patent is extended or adjusted under 35 U.S.C. 154(b) by 25 days.

(21) Appl. No.: 12/942,051

(22) Filed: Nov. 9, 2010

(65) Prior Publication Data

US 2011/0272266 A1 Nov. 10, 2011

(30) Foreign Application Priority Data

Nov. 9, 2009 (EP) ..... 09175444

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS 6,812,814 B2 * 11/2004 Ma et al. ..... 333/262
6,972,650 B2 * 12/2005 Ma ..... 335/78
7,102,472 B1 * 9/2006 Nathanson et al. ..... 335/78
2005/0236260 A1 10/2005 Pasch et al.
2007/0140614 A1 * 6/2007 Kim et al. ..... 385/18
2007/0268095 A1 11/2007 Chou
2011/0147861 A1 6/2011 Steeneken et al.

FOREIGN PATENT DOCUMENTS

EP 1 388 875 A2 2/2004
EP 1 798 745 A2 6/2007

OTHER PUBLICATIONS

Wong, J. et al. "An Electrostatically-Actuated MEMS Switch for Power Applications," Proc. IEEE MEMS 2000, pp. 633-638 (2000).
Extended European Search Report for European Patent Appln. No. 09175444.0 (Mar. 25, 2010)xx.

* cited by examiner

*Primary Examiner* — Bernard Rojas

(57) ABSTRACT

A MEMS switch comprises a substrate, first and second signal lines over the substrate, which each terminate at a connection region, a lower actuation electrode over the substrate and movable contact electrode suspended over the connection regions of the first and second signal lines. An upper actuation electrode is provided over the lower actuation electrode. The connection regions of the first and second signal lines are at a first height from the substrate, wherein signal line portions extending from the connection regions are at a lower height from the substrate, and the lower actuation electrode is provided over the lower height signal line portions, so that the lower height signal line portions are buried. The area available for the actuation electrodes becomes larger and undesired forces and interference are reduced.

18 Claims, 4 Drawing Sheets

PRIOR ART

PRIOR ART

MEMS SWITCH

This application claims the priority under 35 U.S.C. §119 of European patent application no. 09175444.0, filed on Nov. 9, 2009, the contents of which are incorporated by reference herein.

FIELD OF THE INVENTION

This invention relates to MEMS switches, particularly MEMS galvanic switches.

BACKGROUND OF THE INVENTION

A MEMS galvanic switch comprises a first electrode arrangement that is present on a substrate and a movable element that overlies at least partially the first electrode arrangement. The movable element is movable towards the substrate between a first and a second position by application of an actuation voltage.

In the first position, the movable element is separated from the substrate by a gap. The movable element comprises a second electrode that faces the first electrode arrangement. In the second position (closed switch) first and second electrodes are in mechanical and electrical contact with each other.

Known MEMS switches of this type can use electrostatic actuation in which electrostatic forces resulting from actuation drive voltages cause the switch to close. An alternative type uses piezoelectric actuation, in which drive signals cause deformation of a piezoelectric beam. This invention relates particularly to electrostatic switches.

Electrostatic galvanic MEMS switches are promising devices. They usually have 4 terminals: signal input, signal output, and two actuation terminals, one of which usually is kept at ground potential. By varying the voltage on the other actuation terminal, an electrostatic force is generated which pulls the movable structure downward. If this voltage is high enough, one or more contact dimple electrodes will touch and will provide a galvanic connection between the two signal terminals.

FIGS. 1 and 2 show one possible design of MEMS galvanic switch designed in accordance with known design principles.

In FIG. 1, the cross hatched pattern is the bottom electrode layer. This defines the signal in electrode 10, the signal out electrode 12 and lower actuation electrode pads 14. As shown, the actuation electrode pads 14 are grounded.

A top electrode layer defines the movable contact element 16 as well as the second actuation electrode 18 to which a control signal ("DC act") is applied.

The second actuation electrode 18 has a large area overlapping the ground actuation pads so that a large electrostatic force can be generated. However, because the top actuation electrode 18 and the movable contact element 16 are formed from the same layer, a space is provided around the movable contact element 16. Furthermore, overlap of the actuation electrodes and the signal lines is undesirable, as explained further below.

FIG. 2 shows the device in cross section taken through a vertical line in FIG. 1. The same components are given the same reference numbers. FIG. 2 additionally shows the substrate arrangement 2 and the gap 20 beneath the movable contact element 16.

The connection between the signal input and signal output electrodes is made by the movable contact electrode which has two contact dimples as shown in FIG. 2. Galvanic MEMS switches can achieve low resistances Ron of less then 0.5 Ohm when they are switched on, and high isolation with small parasitic capacitance when they are off (Coff<50 fF). Typical dimensions are 30 to 100 μm outer diameter of the actuation electrode 18.

The device is manufactured in well known manner, in which sacrificial etching defines the gap 20.

When scaling galvanic MEMS switches down to lower sizes two problems occur:

the area of the RF in and RF out signal lines becomes relatively large and therefore reduces the area available for the actuation electrodes; and if there is overlap between the signal lines and the actuation electrodes a large RF voltage on the signal line can cause attractive forces on the movable membrane. This can lead to undesired closing or prevent desired opening of the device. Moreover it can cause electrostatic discharges between the signal and actuation electrodes. In FIG. 1, only small connecting bars 22 of the actuation electrode 18 cross the signal lines; these provide structural rigidity to the suspended actuation electrode.

There is therefore a need for a design which enables sizes or actuation voltages to be reduced by maintaining strong electrostatic closing force and avoids interferences between conductor lines within the switch.

SUMMARY OF THE INVENTION

According to the invention, there is provided a MEMS switch, comprising:

- a substrate;
- first and second signal lines over the substrate, which each terminate at a connection region;
- a lower actuation electrode over the substrate;
- a movable contact electrode suspended over the connection regions of the first and second signal lines; and
- an upper actuation electrode provided over the lower actuation electrode,
- wherein the connection regions of the first and second signal lines are at a first height from the substrate, wherein signal line portions extending from the connection regions are at a lower height from the substrate, and wherein the lower actuation electrode is provided over the lower height signal line portions.

In this design, the signal line is covered and shielded by the lower (fixed) actuation electrode. Since the signal line is not in the same layer as one of the actuation electrodes, the area available for the actuation electrodes becomes larger. Since the signal line is electrically shielded by the lower actuation electrode (to which a fixed voltage such as ground can be applied), it cannot exert forces on the movable membrane or cause electrostatic discharge across the actuation gap.

The signal lines can each comprise a feed region at the same height as the connection regions at the opposite end of the lower height signal line portion to the connection region. Thus, electrical connection to the switch can be in conventional manner.

The lower height signal line portions can define an annular well, and the lower actuation electrode has an annular shape. Thus, only a central opening is needed for the connection regions. The annular shape can be circular or any other closed shape. The upper actuation electrode can have a corresponding annular shape.

The upper actuation electrode and the movable contact element are preferably formed from the same layer, for example as part of a movable membrane spaced from the substrate by anchor portions.

The lower height signal line portions and the lower actuation electrode can be arranged to define a microstrip transmission line with desired characteristic impedance. This can be achieved by tuning dimensions of the conductor lines and selecting suitable dielectric materials. For example, a lower dielectric layer can be provided between the lower actuation electrode and the lower height signal line portions, and an upper dielectric layer can be provided over the lower actuation electrode.

The invention also provides a method of manufacturing a MEMS switch, comprising:

forming first and second signal lines over a substrate, which each terminate at a connection region;

forming a lower actuation electrode over the substrate;

forming a movable contact electrode suspended over the connection regions of the first and second signal lines; and forming an upper actuation electrode over the lower actuation electrode, wherein the connection regions of the first and second signal lines are formed at a first height from the substrate, and signal line portions extending from the connection regions are formed at a lower height from the substrate, and wherein the lower actuation electrode is provided over the lower height signal line portions.

The lower height signal line portions and the lower actuation electrode can be designed to define a microstrip transmission line with desired characteristic impedance.

BRIEF DESCRIPTION OF THE DRAWINGS

These and other aspects of the device of the invention will be further explained with reference to the Figures, in which.

DETAILED DESCRIPTION OF EMBODIMENTS

The invention provides a MEMS switch in which the signal lines are partly buried beneath the lower actuation electrode, other than at the end connection regions of signal lines. This means the lower actuation electrode does not need to define an opening for the signal lines, and it also enables improved shielding. It also enables sizes or actuation voltages to be reduced while keeping the actuation force constant.

Figure 3:
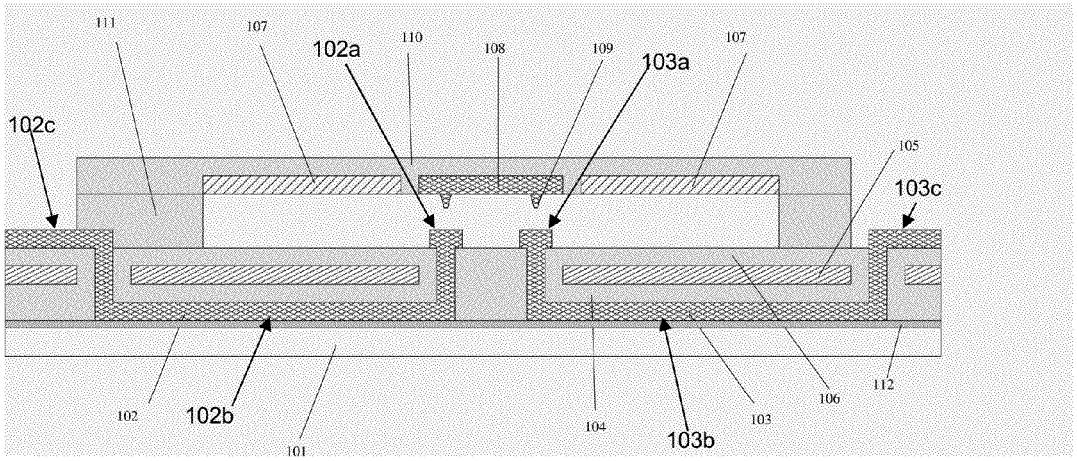
FIG. 3 shows one example of switch of the invention in cross section.

FIG. 3 shows a cross section of a preferred implementation of the invention. A high resistive silicon substrate is used 101. An optional passivation layer 112 of SiN or $SiO_2$ or combination of these is used. After deposition of the passivation layer an Ar ion bombardment can be used to reduce the mobility of carriers near the interface between the substrate and the passivation layer.

Figure 1:
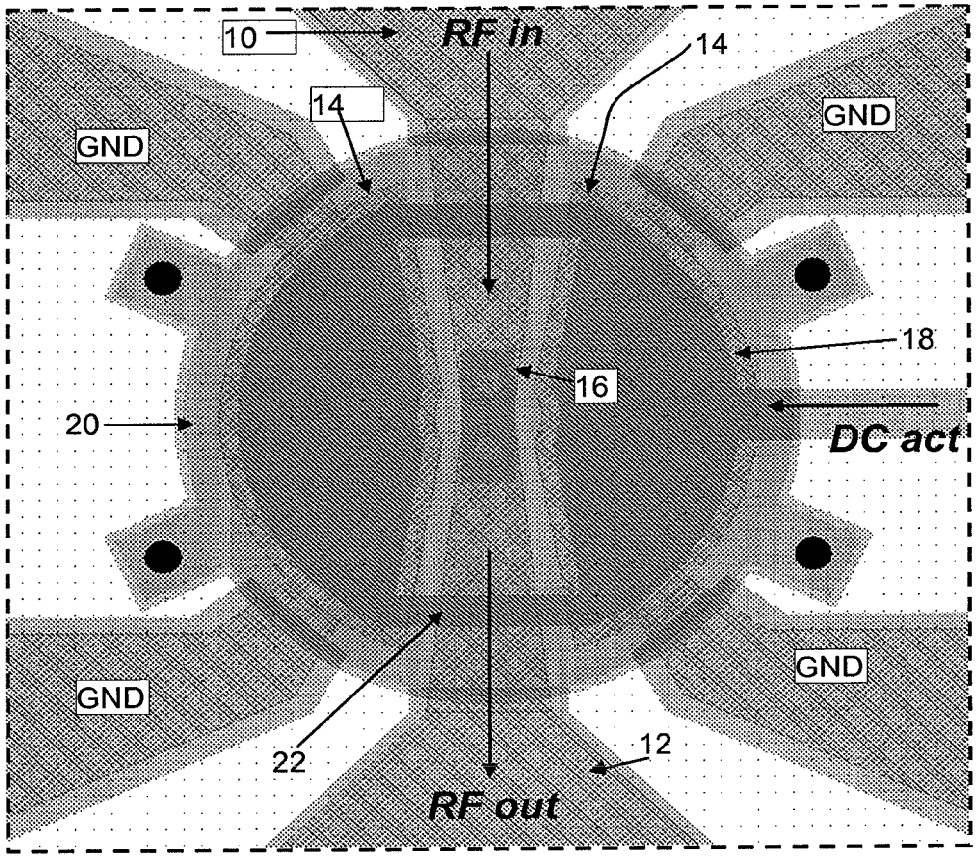
FIG. 1 shows a plan view of a known galvanic piezoelectric MEMS switch.
Figure 2:
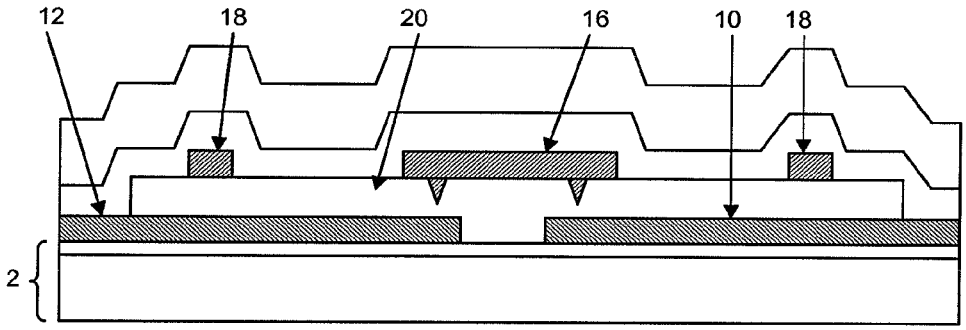
FIG. 2 shows the switch of FIG. 1 in cross section.

The signal input 102 and output 103 lines are significantly different from those in FIG. 2, because they run below the fixed lower actuation electrode 105 instead of at the same height.

A dielectric 104 with thickness $t_{dbot}$ separates the lower signal lines 102,103 from the lower fixed actuation electrode 105. An optional top dielectric layer 106 with thickness $t_{dtop}$ covers the lower actuation electrode and separates the signal lines 102,103 from the lower actuation electrode layer 105. This dielectric layer 106 can prevent currents from flowing between lower actuation electrode 105 and top actuation electrode 107 and between lower actuation electrode 105 and the signal lines 102,103.

Thus, the signal lines are designed so that connection regions 102*a*,103*a* of the first and second signal lines are at a first height from the substrate and buried signal line portions 102*b*, 103*b* extend from the connection regions are at a lower height from the substrate, with the lower actuation electrode 105 over the lower height signal line portions. The signals lines each comprise a feed region 102*c*,103*c* at the same height as the connection regions 102*a*,103*a*.

Applying a voltage between actuation electrodes 105 and 107 generates an electrostatic force which can move the movable membrane 110 and electrodes 107,108 and dimples 109 downward. The moveable structure is supported by anchors 111. When the dimples 109 touch the connection portions 102*a*,103*a* of the signal lines, a galvanic contact is made between the signal lines 102,103 via the dimples 109 and the movable contact electrode 108.

Figure 4:
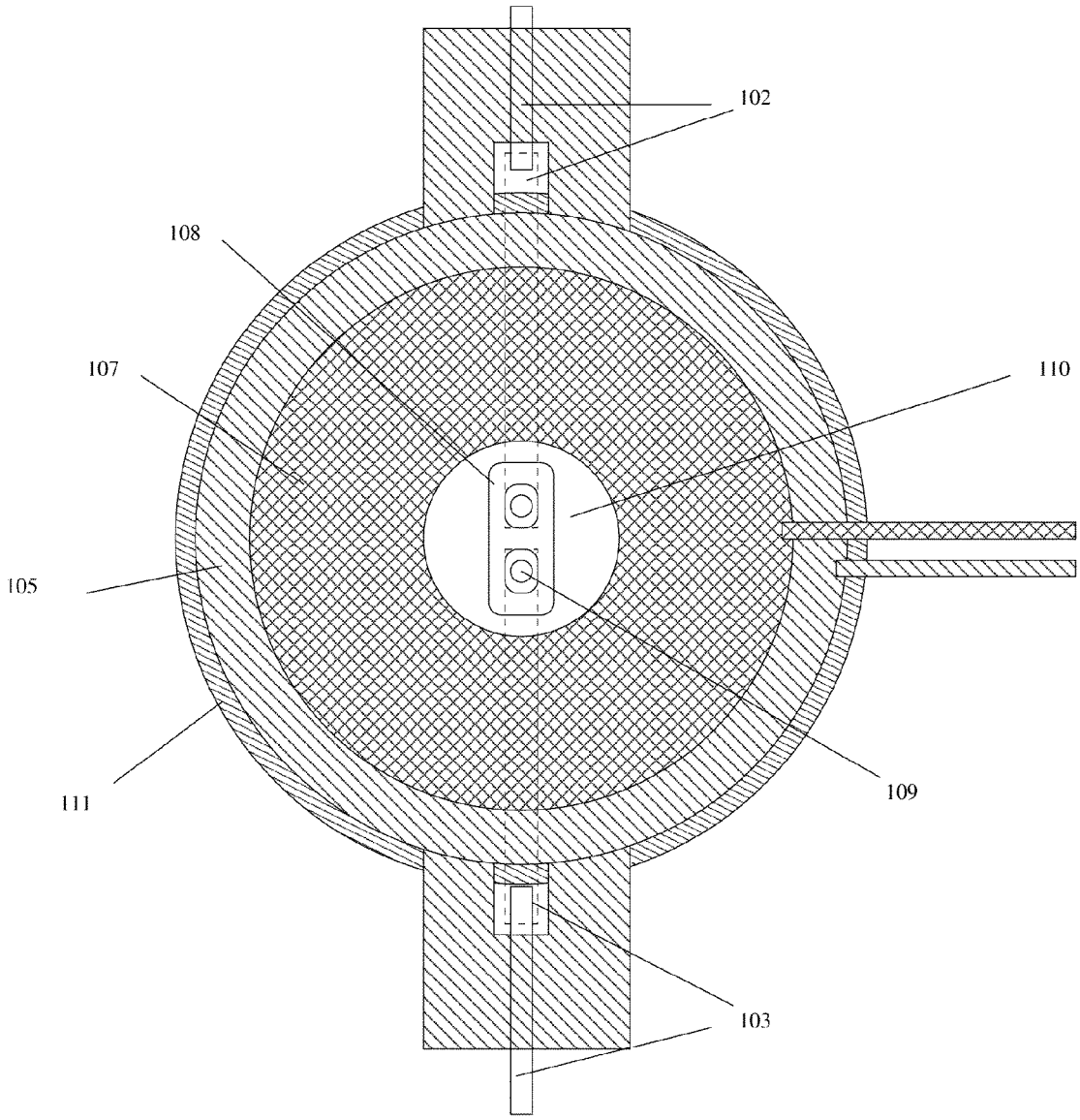
FIG. 4 shows the switch of FIG. 3 in plan view.

A top view is shown in FIG. 4. It is clear that compared to FIG. 2, much more area is available for the actuation electrodes 105 and 107. In fact the area of these two electrodes should be maximized to cover as much of the movable membrane as possible (even more than shown) to maximize the available actuation force.

The preferred shape shown in annular, with the lower height signal line portions 102*b*,103*b* defining an annular well, and the lower actuation electrode 105 and the upper actuation electrode 107 having an annular shape.

There is much more space to make the signal lines 102 and 103 as wide as desired (even though they have been drawn smaller in FIG. 4), this can significantly reduce the series resistance of the switch.

To optimize the RF properties of the switch it is desirable to have the signal and ground actuation electrodes arranged in such a way that they act as a fixed impedance transmission line or waveguide. In FIG. 2 part of the signal line resembles a so called co-planar waveguide. In the implementation of the invention, the signal lines 102,103 can be arranged in combination with the grounded fixed lower actuation electrode 105 in a microstrip line configuration. The required impedance can be achieved by tuning the width of the signal line 102,103 and by tuning the thicknesses and dielectric constants of the dielectric layers and substrate 101,112, 104, 106.

The required way of tuning the thickness and dielectric constant for such a microstripline is known to a person skilled in the art. As an example, $SiO_2$ layers can be used with a dielectric constant of 4 for the dielectric layers 101,112, 104, 106 and a width of 20 microns for the signal line and a thickness of 15 microns for the bottom dielectric 104. Passivation layer 112 is not needed. In that case the microstripline has a characteristic impedance of 50 Ohms.

If the device is used for low frequency signals, it is optimal to make the signal line as wide and thick as possible to minimize its series resistance.

The manufacturing steps will be routine to those skilled in the art.

Only one detailed example has been shown. However, the invention generally provides an arrangement in which the signal lines on the substrate are partially buried beneath the lower actuation electrode. This provides improved shielding thereby enabling the top actuation electrode to cross the location of the signal lines. The lower actuation electrode can be larger because it is in a different layer to the underlying portion of the signal lines. The top of the lower actuation electrode is either coplanar with the top of the contact portions or it is beneath (as shown). Many different configurations can be used, not only the annular design shown.

The application is of particular interest for galvanic switches (analogue switches, RF switches, high power switches).

Various other modifications will be apparent to those skilled in the art.

The invention claimed is:

1. A MEMS switch, comprising:

a substrate;

first and second signal lines over the substrate, each of which terminates at a connection region;

a lower actuation electrode over the substrate;

a movable contact electrode suspended over the connection regions of the first and the second signal lines for at least one of making and breaking electrical contact between the connection regions; and an upper actuation electrode provided over the lower actuation electrode and configured and arranged with the lower actuation electrode to generate an electrostatic force that moves the movable contact electrode for the at least one of making and breaking electrical contact between the connection regions, wherein the connection regions of the first and the second signal lines are at a first height from the substrate, wherein the first and the second signal lines each include a buried signal line portion extending from the connection region and being disposed between a respective portion of the lower actuation electrode and a respective portion of the substrate.

2. A switch as in claim 1, wherein the signals lines each comprise a feed region at the same height as the connection regions at the opposite end of the lower height signal line portion to the connection region.

3. A switch as in claim 1, wherein the lower height signal line portions define an annular well, and the lower actuation electrode has an annular shape.

4. A switch as in claim 3, wherein the upper actuation electrode has an annular shape.

5. A switch as in claim 1, wherein the upper actuation electrode and the movable contact element are formed from a same layer.

6. A switch as in claim 1, wherein the upper actuation electrode and the movable contact element are formed as part of a movable membrane spaced from the substrate by anchor portions.

7. A switch as in claim 1, wherein the lower height signal line portions and the lower actuation electrode define a microstrip transmission line with desired characteristic impedance.

8. A switch as in claim 1, wherein a lower dielectric layer is provided between the lower actuation electrode and the lower height signal line portions.

9. A switch as in claim 1, wherein an upper dielectric layer is provided over the lower actuation electrode.

10. A switch as in claim 1, wherein a fixed voltage is applied to the lower actuation electrode.

11. A switch as in claim 1, wherein the lower actuation electrode is buried at a level between the level of the lower height signal line portions and the signal line connection regions.

12. A switch as in claim 1, further including a dielectric material between the lower and upper actuation electrodes, wherein the lower actuation electrode and the upper actuation electrode are configured and arranged to generate the electrostatic force via the dielectric material, in response to an applied voltage.

13. A switch as in claim 1, wherein the lower actuation electrode and the upper actuation electrode are parallel plates having planar surfaces, and about all of an upper surface of the lower actuation electrode plate facing a lower surface of the upper actuation electrode along a direction that is perpendicular to the planar surfaces.

14. A method of manufacturing a MEMS switch, comprising:

forming first and second signal lines over a substrate, which each terminate at a connection region;

forming a lower actuation electrode over the substrate;

forming a movable contact electrode suspended over the connection regions of the first and second signal lines for at least one of making and breaking electrical contact between the connection regions; and forming an upper actuation electrode over the lower actuation electrode and configured and arranged with the lower actuation electrode to generate an electrostatic force that moves the movable contact electrode for the at least one of making and breaking electrical contact between the connection regions, wherein the connection regions of the first and second signal lines are formed at a first height from the substrate, and the first and the second signal lines each include a buried signal line portion extending from the connection regions and being disposed between a respective portion of the lower actuation electrode and a respective portion of the substrate.

15. A method as in claim 14, further comprising designing the lower height signal line portions and the lower actuation electrode to define a microstrip transmission line with desired characteristic impedance.

16. A method as in claim 14, wherein the lower actuation electrode is formed at a level between the level of the lower height signal line portions and the signal line connection regions.

17. A method as in claim 14, further including forming a dielectric material between the lower and upper actuation electrodes, wherein forming the lower actuation electrode and forming the upper actuation electrode include configuring and arranging the lower actuation electrode and the upper actuation electrode to generate the electrostatic force in response to an applied voltage.

18. A method as in claim 14, wherein forming the lower actuation electrode includes forming a first plate having planar surfaces, and forming the upper actuation electrode includes forming a second plate having planar surfaces that are about parallel to the planar surfaces of the first plate another, with about all of an upper surface of the first plate facing a lower surface of the second plate along a direction that is perpendicular to the planar surfaces.

* * * * *